US008567661B2

(12) United States Patent
Sullivan et al.

(10) Patent No.: US 8,567,661 B2
(45) Date of Patent: Oct. 29, 2013

(54) TWO-PIECE SHIPPING TRAY

(75) Inventors: Thomas J. Sullivan, Thornton, CO (US); Terence A. Gill, Niwot, CO (US); David C. DeLine, Cherry Hills Village, CO (US)

(73) Assignee: DeLine Box Company, Denver, CO (US)

( * ) Notice: Subject to any disclaimer, the term of this patent is extended or adjusted under 35 U.S.C. 154(b) by 0 days.

(21) Appl. No.: 13/602,075

(22) Filed: Aug. 31, 2012

(65) Prior Publication Data

US 2013/0056528 A1 Mar. 7, 2013

Related U.S. Application Data

(60) Provisional application No. 61/573,293, filed on Sep. 2, 2011.

(51) Int. Cl.
*B65D 5/49* (2006.01)
*B65D 25/04* (2006.01)

(52) U.S. Cl.
USPC ..... 229/120.24; 229/120.26; 229/120.28; 229/120.31; 229/178; 229/915

(58) Field of Classification Search
USPC ..... 229/120.17, 120.18, 120.24, 120.26, 229/120.28, 120.29, 120.31
See application file for complete search history.

(56) References Cited

U.S. PATENT DOCUMENTS

| | | | | | |
|---|---|---|---|---|---|
| 2,690,285 | A | * | 9/1954 | Main | 229/915 |
| 2,903,176 | A | * | 9/1959 | Crane | 229/915 |
| 2,998,909 | A | * | 9/1961 | Anderson, Jr. et al. | 229/178 |
| 3,102,674 | A | * | 9/1963 | Hamilton | 229/178 |
| RE26,386 | E | * | 5/1968 | Crane | 229/178 |
| 4,349,147 | A | | 9/1982 | Jensen | |
| 4,356,952 | A | | 11/1982 | Rekow | |
| 4,372,476 | A | * | 2/1983 | Harned et al. | 229/915 |
| 5,361,975 | A | | 11/1994 | Droste et al. | |
| 5,516,034 | A | | 5/1996 | Jensen et al. | |
| 6,112,977 | A | * | 9/2000 | Sutherland et al. | 229/120.18 |
| 6,676,012 | B1 | | 1/2004 | Southwell et al. | |
| 6,899,266 | B2 | | 5/2005 | Conway | |
| 2005/0199689 | A1 | * | 9/2005 | Chang | 229/120.17 |

OTHER PUBLICATIONS

U.S. Appl. No. 61/573,293, filed Sep. 2, 2011.

* cited by examiner

*Primary Examiner* — Gary Elkins
(74) *Attorney, Agent, or Firm* — Craig R. Miles; CR Miles, P.C.

(57) ABSTRACT

A two piece shipping tray having a first unitary blank which provides a bottom panel with opposed end panels and opposed side panels connected by foldable corner gussets and a second unitary blank which provides a two walled cross divider adhered in fixed relation to the bottom panel to provide a knocked-down-flat condition in which the two walled cross divider foldably engages the bottom panel and in which the opposed side panels have a portion of the corresponding foldable corner gussets adhered in fixed relation to the opposed end panels to engage each of the opposed side panels with the bottom panel, which allows the basic configuration of the shipping tray to be manually foldably produced from the knocked-down-flat condition.

3 Claims, 5 Drawing Sheets

TWO-PIECE SHIPPING TRAY

This United States Non-Provisional patent application claims the benefit of U.S. Provisional Patent Application No. 61/573,293, filed Sep. 2, 2011, hereby incorporated by reference herein.

I. BACKGROUND

A two piece shipping tray having a first unitary blank which provides a bottom panel with opposed end panels and opposed side panels connected by foldable corner gussets and a second unitary blank which provides a two walled cross divider adhered in fixed relation to the bottom panel to provide a knocked-down-flat condition in which the two walled cross divider folds to engage the bottom panel and in which a portion of each foldable corner gusset adhered in fixed relation to corresponding one of the opposed end panels foldably disposes the opposed side panels adjacent with the bottom panel, which allows the basic configuration of the shipping tray to be manually foldably produced from the knocked-down-flat condition.

Presently, conventional shipping trays are shipped to the point of use in the form of blanks cut from sheet material. The blanks are configured for assembly into the final form of the shipping tray by automated machine process and the assembled shipping trays can then be distributed into the field for packaging of goods such as tomatoes, grapes, berries or the like. A substantial problem with these conventional shipping trays and method of assembly can be that automated machinery for assembly of the shipping tray must be located at the point to which the blanks are shipping. Typically the blanks are not configured to be assembled manually. Accordingly, the conventional process to produce and provide an assembled shipping tray at the location for packing goods can include steps that are both costly and time consuming.

The instant invention provides a two-piece shipping and display container adapted to provide a knock-down-flat condition and a basic configuration of a shipping tray useful for shipping goods which overcomes in whole or in part certain of the forgoing disadvantages of conventional shipping trays.

II. SUMMARY OF THE INVENTION

Accordingly, a broad object of the invention can be to provide embodiments of a two-piece shipping tray which can be shipped in a knock-down-flat condition to the point of use and which can be readily assembled manually without the use of machines into the basic configuration of the shipping tray. The knock-down-flat condition of embodiments of the two piece shipping tray comprising at least a first unitary blank which includes a bottom panel integrally connected to pairs of opposed side panels and opposed end panels along corresponding pairs of side panel fold lines and end panel fold lines; a corner gusset integrally connected between adjacent ends of said pairs of opposed side panels and opposed end panels along a first gusset fold line and a second gusset fold line, each corner gusset having a diagonal fold line which defines a first gusset portion and a second gusset portion, said first gusset portion adhesively fixed adjacent an inside surface of a corresponding one of said opposed end panels; and a second unitary blank which includes a divider top panel to which each of a first divider side panel and a second divider side panel integrally connected along corresponding a first divider top panel fold line and second divider top panel fold line; and a first glue flap and a second glue flap integrally connected adjacent said first divider side panel and said second divider side panel along corresponding glue flap fold lines, and wherein the second unitary blank folds medially along said second glue flap fold line to allow adhesive fixed relation of inside surfaces of said first glue flap and said second glue flap, said second glue flap adhesively fixed to said bottom panel to dispose the external surface of said first or second divider panel in adjacent relation to said bottom panel.

Another broad object of the invention can be to provide embodiments of a two-piece shipping tray which can be foldably assembled from the knock-down-flat condition to include a bottom panel integrally connected to pairs of opposed side panels and opposed end panels along corresponding pairs of side panel fold lines and end panel fold lines; a corner gusset integrally connected between adjacent ends of said pairs of opposed side panels and opposed end panels along a first gusset fold line and a second gusset fold line, each corner gusset having a diagonal fold line which defines a first gusset portion and a second gusset portion, said first gusset portion adhesively fixed adjacent an inside surface of a corresponding one of said opposed end panels, each said corner gusset folds along said first diagonal fold line to dispose said opposed side panels and opposed end panels in upright relation to said bottom panel; a divider panel including a divider top panel to which each of a first divider side panel and a second divider side panel integrally connect along a first divider top panel fold line and second divider top panel fold lines to dispose said first divider side panel and second divider side panel in opposed relation a distance apart; and a first glue flap and a second glue flap integrally connected adjacent said first divider side panel and said second divider side panel along corresponding glue flap fold lines, wherein inside surfaces of said first glue flap and said second glue flap adhesively secure to maintain said first divider side panel an said second divider side panel said distance apart, and wherein an external surface of said second glue flap adhesively secures said divider panel to said bottom panel, said divider panel extending between said pair of opposed sides to divide said shipping tray interior into two portions.

Another broad object of the invention can be to provide a method of manufacturing a two-piece shipping tray adapted to provide a knocked-down-flat condition in which a two walled cross divider foldably engages the bottom panel and in which the opposed side panels have a portion of the corresponding foldable corner gussets adhesively fixed to the opposed end panels to engage each of the opposed side panels with the bottom panel.

Another broad object of the invention can be to provide a method of assembling a two piece shipping tray from the knock-down-flat condition which can be accomplished manually without the use of machines by merely drawing the opposed side panels into the standing upright position thereby also drawing the opposed end panels into standing upright position and by further folding opposed reinforcing panel inward to lock the standing upright position of the opposed side and end panels. A cross divider can established in the standing upright position by foldably engaging locking tabs between a first and second divider panels.

Naturally, further objects of the invention are disclosed throughout other areas of the specification, drawings, photographs, and claims.

III. A BRIEF DESCRIPTION OF THE DRAWINGS

Figure 3:
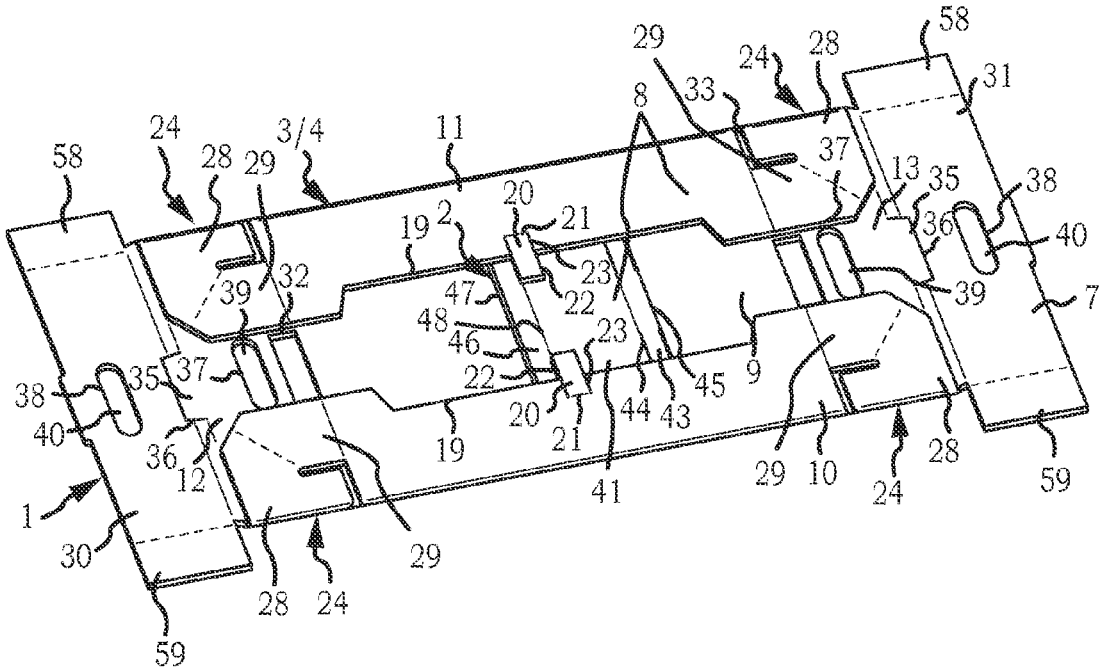
FIG. 3 is a perspective view of the knock-down-flat condition of the basic configuration of the two piece shipping tray shown in FIG. 1.
Figure 5:
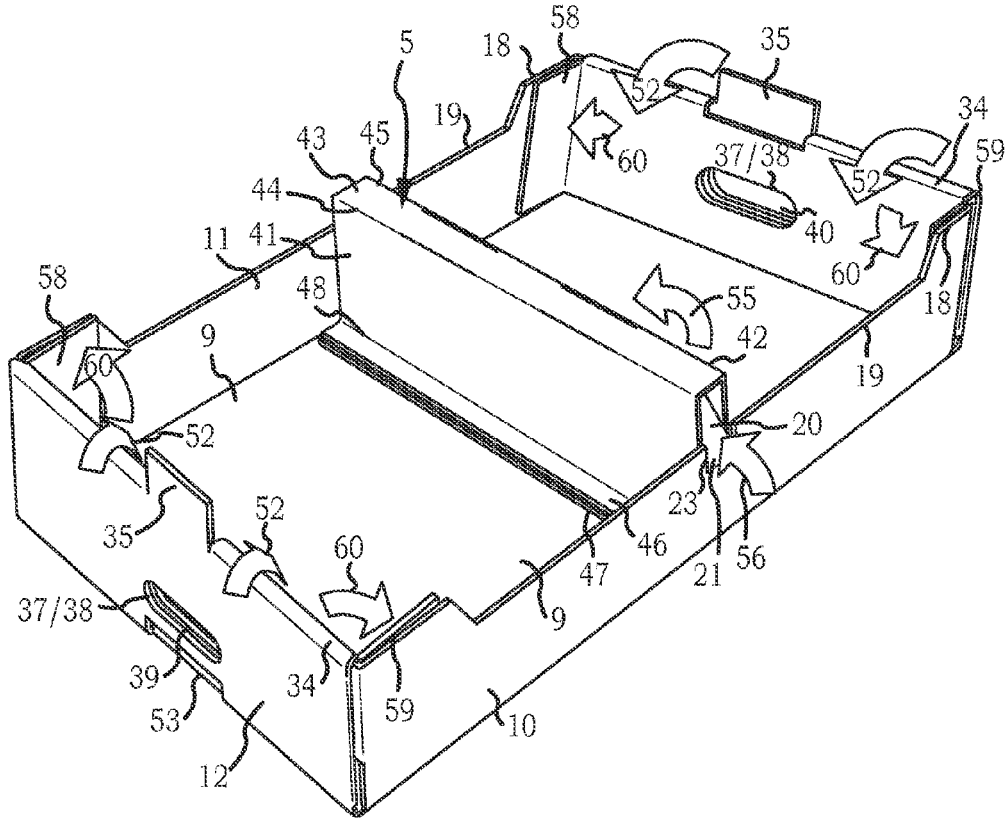

FIG. 5 is a perspective view of a basic configuration of the two piece shipping tray produced from the knock-down-flat of the two piece tray shown in FIG. 3 by further establishing a two walled cross divider in upright relation to the bottom panel and upstanding tabs inwardly folded between the two walls of the cross divider and by inwardly folding opposed reinforcing panels to engage the inside of the opposed end panels.

IV. DETAILED DESCRIPTION OF THE PREFERRED EMBODIMENTS

Figure 1:
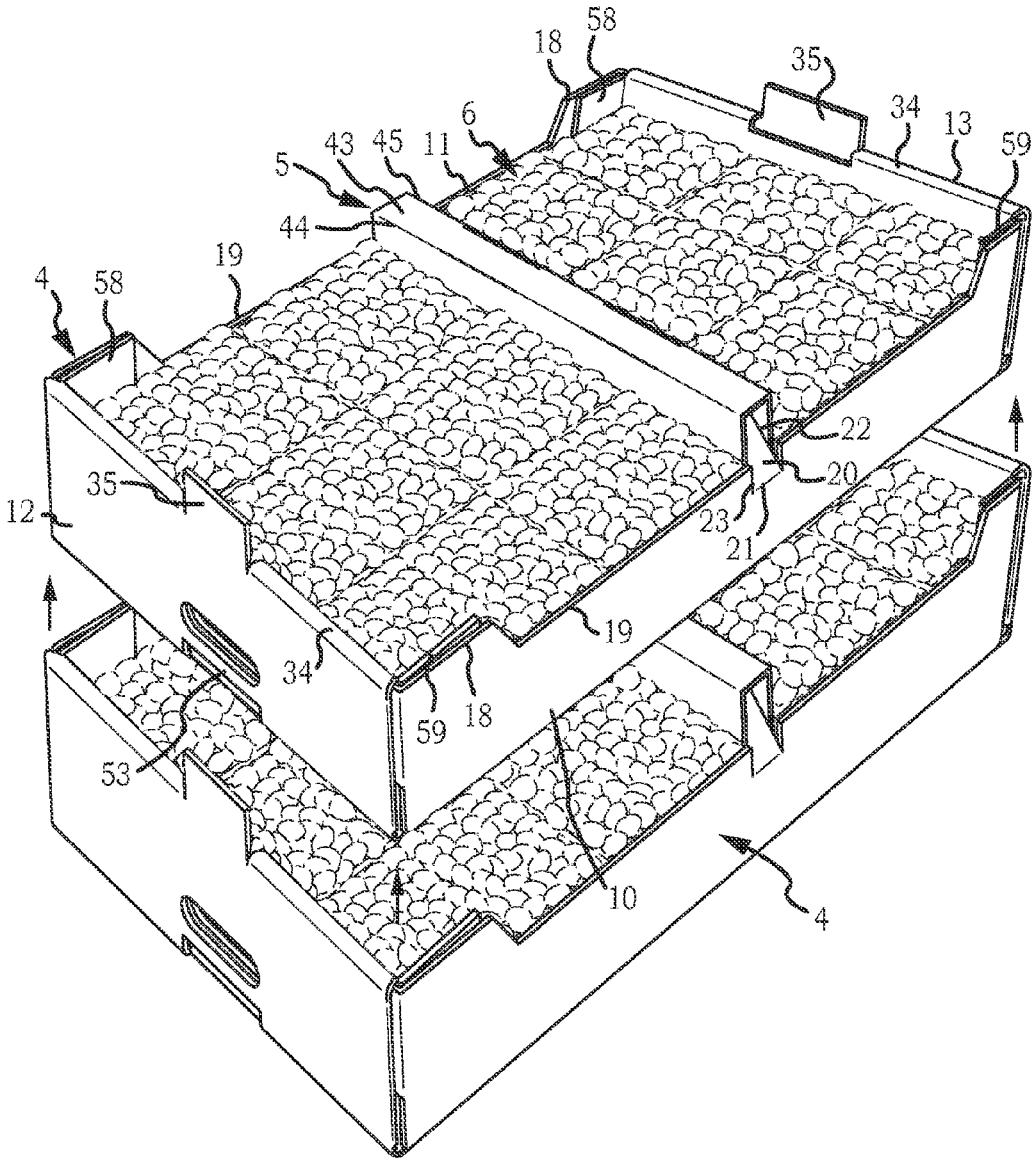
FIG. 1 is a perspective view of a particular embodiment of the basic configuration of the two piece shipping tray adapted for packaging berries.
Figure 4:
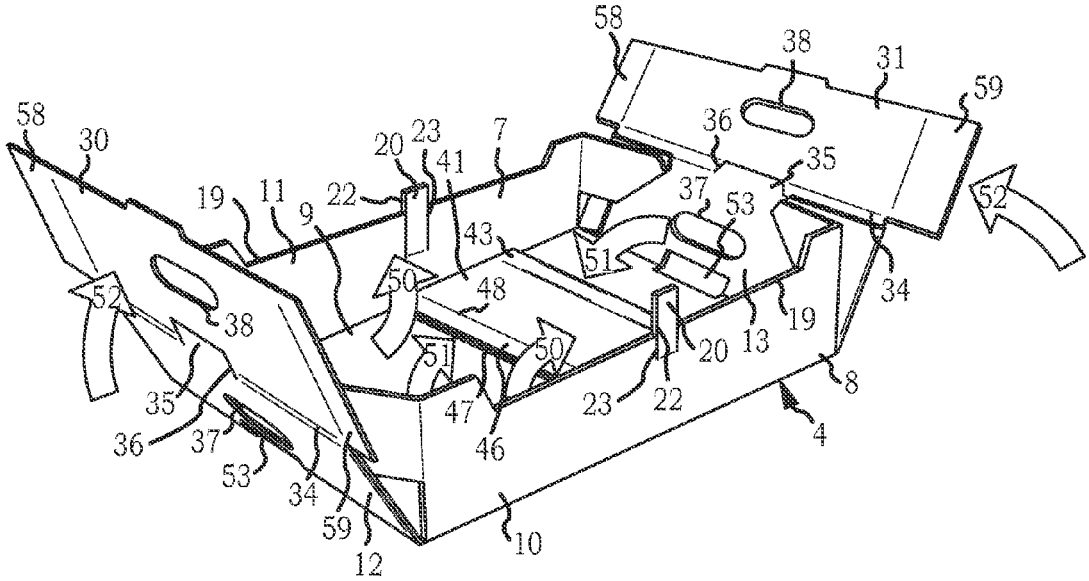
FIG. 4 is a perspective view of a basic configuration of the two piece shipping tray produced from the knock-down-flat of the two piece tray shown in FIG. 3 by establishing the opposed side panels and opposed end panels in upright relation to the bottom panel.

Now generally referring to FIGS. 1-5, a first unitary blank (1) and a second unitary blank (2) (as shown in the example FIG. 2) can be assembled to provide a knock-down-flat condition (3) (as shown in the example FIG. 3) of a shipping tray (4) having a cross divider (5) which can be foldably assembled by hand even in field conditions (as shown in the examples of FIGS. 4 and 5) to form the basic configuration of a shipping tray (4) (as shown in the example of FIGS. 1 and 5). The first unitary blank (1) and the second unitary blank (2) can be readily manufactured and assembled by automated production processes to provide the knock-down-flat condition (3) of the basic configuration of the shipping tray (4). The knock-down-flat condition (3) of the shipping tray (4) can be conveniently bundled and shipped to the user for foldable assembly by hand to form the finished basic configuration of the shipping tray (4). The basic configuration of the shipping tray (4) can be adapted for shipping a wide variety of goods (6); although FIG. 1 shows the shipping tray (4) adapted for the shipment of tomatoes, grapes, berries such as raspberries, strawberries, blueberries, or the like.

Figure 2:
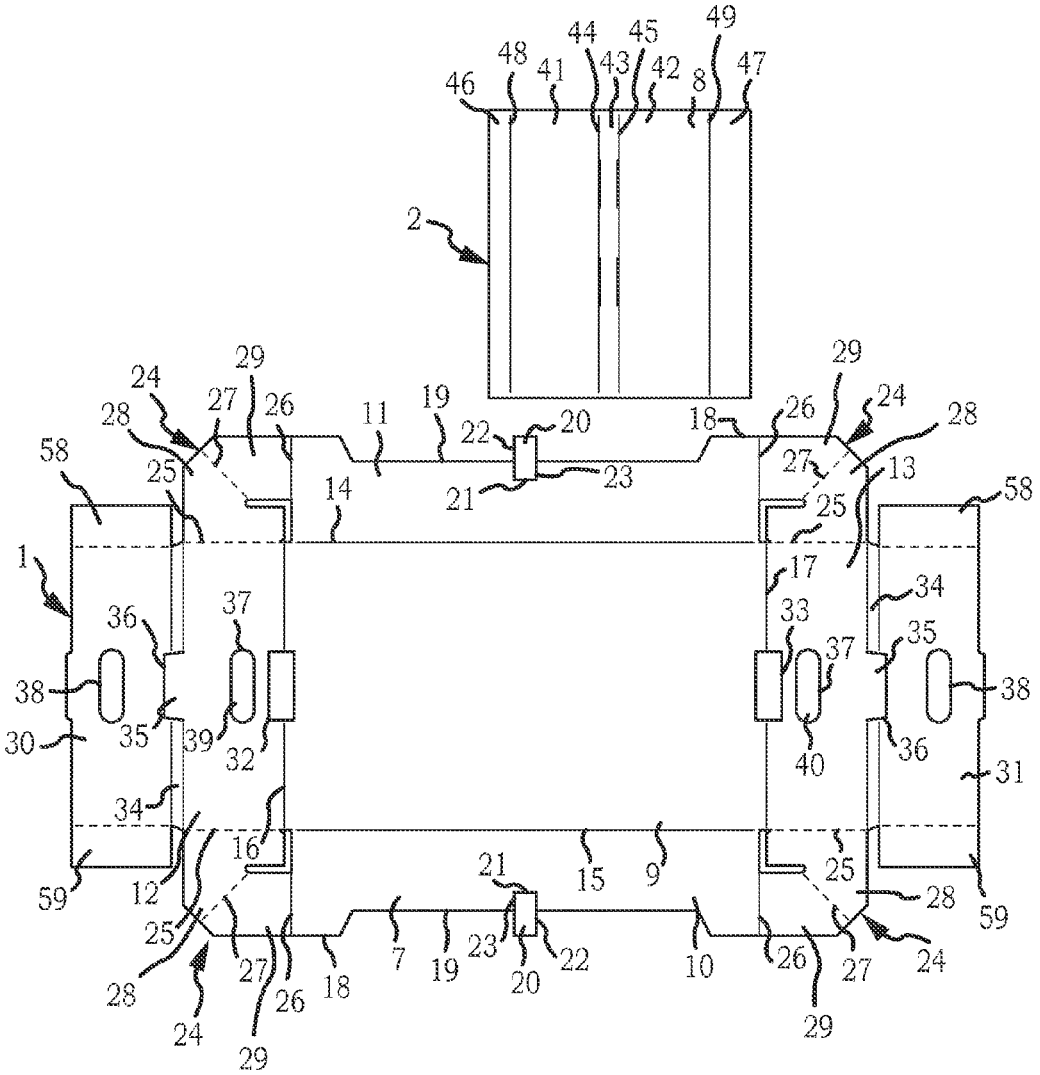
FIG. 2 is a plan view of a particular embodiment of each of a first unitary blank and a second unitary blank which can be assembled to provide the basic configuration of the two piece shipping tray shown in FIG. 1.

Now referring primarily to FIG. 2, the first unitary blank (1) and the second unitary blank (2) can be made from flat sheet corrugated paperboard as widely used in the art; however, the invention is not so limited, and the first unitary blank (1) and the second unitary blank (2) can be made from a wide variety of sheet materials including, but not limited to, uncorrugated paper board, corrugated paper board, plastic sheet material, foldable laminates of multiple similar or dissimilar layers, or the like.

Again referring primarily to FIG. 2, the first unitary blank (1) having an inside surface (7) and an outside surface (8)(see FIG. 3) provides a bottom panel (9) integrally connected to opposed side panels (10)(11) and opposed end panels (12)(13) along a corresponding side panel fold lines (14)(15) and end panel fold lines (16)(17). Each end panel fold line (16)(17) can be medially interrupted by a rectangular cut out (32)(33) a portion disposed on opposite sides of the end panel fold line (16)(17). The terminal edge (18) of each of the opposed side panels (10)(11) can have a recessed medial portion (19) which can be medially interrupted by an outwardly extending locking tab (20). As to certain embodiments, the locking tab (20) can have a base (21) integrally connected inward of the terminal edge (18) and having tab sides (22) foldably separable from the corresponding one of the opposed side panels (10)(11) at corresponding locking tab separation lines (23). Corner gussets (24) integrally connect between one of the opposed end panels (10)(11) and the adjacent one of the opposed end panels (12)(13). Each corner gusset (24) being foldably connected to the one of the opposed end panels (12)(13) along a first gusset fold line (25) and being connected to the adjacent one of the opposed side panels (10)(11) along a second gusset fold line (26). Each corner gusset (24) has a centrally disposed fold line (27) which diagonally divides each corner gusset (24) to define a first gusset portion (28) connected adjacent a corresponding end panel (12)(13) and a second gusset portion (29) connected adjacent a corresponding side panel (10)(11). The centrally disposed fold line (27) allows each corner gusset (24) to fold inwardly to a engage a surface of the first gusset portion (28) adjacent the inside surface (7) of a corresponding one of the opposed end panels (12)(13) (as shown in the example of FIG. 4). Opposed reinforcing panels (30)(31) integrally connect adjacent each one of the opposed end panels (13)(14) along a reinforcing panel fold line (34) which can be medially interrupted by an outwardly extending stacking tab (35) having a configuration defined by a stacking tab separation line (36). Each opposed end panel (12)(13) and each of the opposed reinforcing panels (30)(31) can have an aperture (37)(38) providing a pass through (39)(40) adapted on assembly to receive a part of the hand. Opposed reinforcing flaps (58)(59) can be foldably connected to opposed ends of each the opposed reinforcing panels (30)(31).

Again referring primarily to FIG. 2, the second unitary blank (2) having an inside surface (7) and an outside surface (8) provides a first divider side panel (41) and a second divider side panel (42) each of which are integrally connected to a divider top panel (43) along a corresponding pair of divider panel fold lines (44)(45). Opposed first and second glue flaps (46)(47) integrally connect adjacent the bottom of each of first divider side panel (41) and the second divider side panel (42) along corresponding glue flap fold lines (48)(49).

The term "fold lines" may take any suitable form as known in the art, such as score and crease lines for the purpose of folding panels in relation to one another but not for the purposes of detaching the panels from one another.

The term "separation line" may take any suitable form as known in the art, such as slits, perforations, punctures, holes or the like which can be continuous or located in sufficient proximity to one another to allow detachment or separation of panels or portions of panels upon forcible urging. The amount of forcible urging required to separate or detach panels or portions of the panels adjusted by configuration of the separation line or the configuration of the slits, perforations, punctures or holes.

Now referring primarily to FIG. 3, a particular embodiment of the knock-down-flat condition (3) of a basic configuration of the shipping tray (4) (as shown in the example of FIG. 1). The knock-down-flat condition (3) can be made by automated process; however, the invention is not so limited and manual process can be utilized. In producing the knock-down-flat condition (3), the second unitary blank (2) can be folded medially along a second divider panel fold lines (45) to dispose inside surfaces (7) of the first divider side panel (41) and the second divider panel (42) in adjacent engaged relation. Adhesive applied between inside surfaces (7) of the first and second glue flaps (46)(47) can dispose the glue flaps (46)(47) in adhesive fixed relation. The outside surface (8) of second glue flap (47) can adhesively fixed to the inside surface (7) of the bottom panel (9) to dispose the outside surface (8) of the second divider side panel (42) in adjacent engaged relation to the inside surface (7) of the bottom panel (9).

Each of the opposed side panels (10)(11) and the corresponding corner gussets (24) can be folded inwardly to dispose the inside surfaces (7) of the corner gussets (24) adjacent the corresponding inside surfaces (7) of the bottom panel (9) and opposed end panels (12)(13) and laying in part over the folded flat first and second divider panels (41)(42) (as shown in the example of FIG. 3). Adhesive applied between the inside surface (7) of each of the first gusset portions (28) disposes each of the first gusset portions (28) in adhesive fixed relation to the corresponding one of the opposed end panels (12)(13).

Now referring primarily to FIGS. 4 and 5, the basic configuration of the shipping tray (4) can be produced from the knock-down-flat condition (3) by drawing outwardly (50) each the opposed side panels (10)(11) into standing upright relation to the bottom panel (9) which thereby correspondingly draws inwardly (51) each of the opposed end panels (12)(13) into standing upright relation to the bottom panel (9), as shown in FIG. 4. Each of the opposed reinforcing panels (30)(31) can be folded inwardly (52) along the corresponding reinforcing panel fold lines (34) to dispose the inside surface (7) of each of the opposed reinforcing panels (30)(31) in adjacent engaged relation with the corresponding inside surface (7) of each of the opposed end panels (12)(13) aligning the corresponding apertures (37)(38) as shown in FIG. 5. Folding inwardly (52) of each of the opposed reinforcing panels (30)(31) along the corresponding reinforcing panel fold lines (34) separates each of the opposed reinforcing panels (30)(31) from the corresponding stacking tab (35) along the stacking tab separation line (36) leaving the stacking tab (35) in the standing upright position (as shown in the example of FIG. 5). Also, folding inwardly (52) of each of the reinforcing panels (30)(31) generates corresponding opposed stacking tab receiving slots (53). The reinforcing flaps (58)(59) can be folded (60) adjacent the inside (7) surface of corresponding one of the opposed side panels (10)(11).

The first divider side panel (41) and the second divider side panel (42) can be drawn (55) into standing upright relation to the bottom panel (9) to establish the first and second divider side panels (41)(42) in fixed substantially parallel relation a distance apart to provide the cross divider (5) which extends between the opposed side panels (10)(11) (as shown in example FIG. 5). Each locking tab (20) can be folded inwardly (56) to separate from the corresponding one of the opposed side panels (10)(11) along the corresponding locking tab separation lines (23) and disposed between the first divider panel (41) and the second divider panel (42) to fix the cross divider (5) in standing upright relation to the bottom panel (9) to form the basic configuration of the shipping tray (4) as shown in the example of FIG. 1.

Now referring primarily to FIG. 1, the formed basic configuration of the shipping tray (4) can be useful for shipping goods (6), as above described. A plurality of shipping trays (4) can be disposed in stacked relation by inserting the opposed stacking tabs (35) in the correspondingly opposed stacking tab receiving slots (53) as shown in FIG. 1, broken line.

From the foregoing, it can be understood that the inventive shipping tray (4), as to certain embodiments, can be provided as a knock-down-flat condition (3) of ready automated mass production, economical of manufacture and shipment and particularly adapted for ready hand assembly in the field without the use of any machine. By interconnecting the components of the shipping tray (4) as described above, a sturdy shipping tray (4) adapted for stacked shipment by insertion of the stacking tabs (35) of a first shipping tray (4) into the associated stack tab receiving slots (53) of a second shipping tray (4) can be readily produced. While the inventive shipping tray (4) is show in one illustrative form; the invention is not limited to the particular combination of elements of the illustrative form and it will be obvious to those skilled in the art that it is susceptible of various changes and modifications without departing from the generic elements of the invention.

As can be easily understood from the foregoing, the basic concepts of the present invention may be embodied in a variety of ways. The invention involves numerous and varied embodiments of a two-piece shipping tray and methods of making and using the two-piece shipping tray (4) including, but not limited to, the best mode of the invention.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "divider" should be understood to encompass disclosure of the act of "dividing" —whether explicitly discussed or not—and, conversely, were there effectively disclosure of the act of "dividing", such a disclosure should be understood to encompass disclosure of a "divider" and even a "means for dividing." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a container" refers to one or more of the containers. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

Thus, the applicant(s) should be understood to claim at least: i) each of the shipping trays herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A shipping tray having a knock-down-flat-condition, comprising:

a) a first unitary blank which includes:

i) a bottom panel integrally connected to pairs of opposed side panels and opposed end panels along corresponding pairs of side panel fold lines and end panel fold lines;

ii) a corner gusset integrally connected between adjacent ends of each of said pairs of opposed side panels and opposed end panels along a first gusset fold line and a second gusset fold line, each corner gusset having a diagonal fold line which defines a first gusset portion and a second gusset portion, said first gusset portion adhesively fixed adjacent an inside surface of a corresponding one of said opposed end panels; and b) a second unitary blank which includes:

i) a divider top panel to which each of a first divider side panel and a second divider side panel integrally connected along corresponding a first divider top panel fold line and second divider top panel fold line; and ii) a first glue flap and a second glue flap integrally connected adjacent said first divider side panel and said second divider side panel along corresponding glue flap fold lines, and wherein the second unitary blank folds medially along said second glue flap fold line to allow adhesive fixed relation of inside surfaces of said first glue flap and said second glue flap, said second glue flap adhesively fixed to said bottom panel to dispose the external surface of said first or second divider panel in adjacent relation to said bottom panel.

2. The shipping tray of claim 1, further comprising a pair of opposed reinforcing panels integrally connected to said opposed end panels along a corresponding pair of reinforcing panel fold lines.

3. The shipping tray of claim 1, further comprising a locking tab integrally connected to at least one of said opposed sides, said locking tab extending a distance outward of a terminal edge of said at least one of said opposed side panels.

* * * * *